US005505625A

United States Patent [19]

Byer et al.

[11] Patent Number: 5,505,625

[45] Date of Patent: Apr. 9, 1996

[54] CONNECTOR ASSEMBLY FOR ELECTRICALLY INTERCONNECTING TWO PRINTED CIRCUIT BOARD LIKE MEMBERS

[75] Inventors: Charles Byer, Palo Alto; Gary Yasumura, Santa Clara; Mike Perry, Woodside; Russell Larsen, San Jose, all of Calif.

[73] Assignee: Beta Phase, Inc., Menlo Park, Calif.

[21] Appl. No.: 243,877

[22] Filed: May 17, 1994

[51] Int. Cl.[6] ..... H01R 9/09

[52] U.S. Cl. ..... 439/62; 439/67

[58] Field of Search ..... 439/62, 67, 632, 439/493, 77, 637

[56] References Cited

U.S. PATENT DOCUMENTS

| | | | |
|---|---|---|---|
| 3,401,369 | 9/1968 | Palmateer et al. | 439/62 OR |
| 4,881,908 | 11/1989 | Perry et al. | 439/161 |
| 4,907,975 | 3/1990 | Dranchak et al. | 439/632 X |
| 4,911,643 | 3/1990 | Perry et al. | 439/67 |
| 5,044,980 | 9/1991 | Krumme et al. | 439/67 X |
| 5,181,853 | 1/1993 | Van Brunt, Jr. et al. | 439/67 |
| 5,195,897 | 3/1993 | Kent et al. | 437/67 OR |
| 5,308,249 | 5/1994 | Renn et al. | 439 OR/62 |

*Primary Examiner*—P. Austin Bradley
*Assistant Examiner*—Daniel Wittels
*Attorney, Agent, or Firm*—Burns, Doane, Swecker & Mathis

[57] ABSTRACT

A connector assembly for electrically interconnecting first and second printed circuit board like members having electrical contacts thereon includes an elongated biasing member for being mounted on the first printed circuit board like member and flexible circuitry mounted on the biasing member. The biasing member possesses arm portions which are spaced apart to define therebetween a longitudinal opening for receiving a second printed circuit board like member. The flexible circuitry mounted on the biasing member includes a plurality of generally parallel-spaced electrical conductors for being electrically connected with the electrical contacts on the first printed circuit board like member when the biasing member is mounted on the first printed circuit board like member. The electrical conductors on the flexible circuitry each terminate at a contact pad and the flexible circuitry is positioned on the biasing member so that the contact pads are positioned on opposite sides of the longitudinal opening to effect an electrical connection with the electrical contacts on the second printed circuit board like member when the second printed circuit board like member is received within the longitudinal opening. An elastomer sheet is positioned between the contact pads of the flexible circuitry and the arm portions of the biasing member for allowing individual contact pads to move relative to other contact pads so as to compensate for height variations of the various electrical conductors on the second printed circuit board like member and thickness variations in the second printed circuit board like member.

17 Claims, 4 Drawing Sheets

CONNECTOR ASSEMBLY FOR ELECTRICALLY INTERCONNECTING TWO PRINTED CIRCUIT BOARD LIKE MEMBERS

FIELD OF THE INVENTION

The invention relates to connector assemblies. More particularly, the present invention pertains to connector assemblies that are adapted to be mounted on one printed circuit board like member for receiving another printed circuit board like member to establish electrical continuity between the two printed circuit board like members.

BACKGROUND OF THE INVENTION

Printed circuit boards and the like are oftentimes provided with an arrangement that allows another circuit board or the like to be electrically connected thereto. For example, a motherboard or back plane board can be outfitted to allow a daughterboard or plug-in board to be electrically connected thereto. FIG. 1 illustrates a known type of arrangement for electrically interconnecting one printed circuit board like member with another printed circuit board like member.

As seen in FIG. 1, an existing printed circuit board or printed wiring board 10 (e.g., a motherboard or back plane board) has a connector element 12 mounted thereon. The connector element 12 includes a mounting member 14 which can be secured to a mounting block 16 for purposes of being secured to the upper surface of the printed circuit board 10. The mounting member 14 is defined by spaced apart spring-like portions 18 which define therebetween a longitudinal opening 20.

The connector element 12 also includes flexible circuitry 22 disposed on the outer surface of the mounting member 14. The flexible circuitry 22 includes a plurality of generally parallel spaced apart electrical conductors 24. As seen more clearly in FIG. 2, each of the electrical conductors 24 terminates in a contact 26.

The flexible circuitry 22 is positioned on the mounting member 14 in the manner illustrated in FIG. 3 with the ends or leads 28 of the flexible circuitry 22 electrically connected to electrical conductors or contacts 30 on the printed circuit board 10. In that way, an electrical interconnection is established between the electrical contacts 26 of the flexible circuitry 22 and the contacts 30 on the printed circuit board 10. As seen in FIG. 3, an adhesive layer 32 is interposed between the mounting member 14 and the flexible circuitry 22 to secure the flexible circuitry 22 to the mounting member 14.

The longitudinal opening 20 in the connector element 12 is adapted to receive another printed circuit board or printed wiring board 34 (e.g., a daughterboard or plug-in board) which has electrical conductors or contacts 36 disposed thereon. Upon insertion of the printed circuit board 34 into the longitudinal opening 20 in the connector element 12, the electrical conductors or contacts 36 on the printed circuit board 34 mate with and establish an electrical connection with respect to the electrical contacts 26 on the flexible circuitry 22. Thus, an electrical connection is established between the electrical conductors or contacts 36 on the daughterboard or plug-in board 34 and the electrical conductors or contacts 30 on the motherboard or back plane board 10.

In order effect proper electrical continuity between the two printed wiring boards 10, 34, it is necessary that each contact pad 26 of the flexible circuitry 22 make positive physical contact with the electrical conductors or contact pads 36 on the daughterboard or plug-in board 34 that is received in the longitudinal opening 20 of the connector element 12. It has been found, however, that the thickness of the printed circuit board 34 is not always constant from one area of the board to the next. In addition, variations oftentimes exist with respect to the height of adjacent contacts 36 on the printed circuit board 34. When the variations in printed circuit board thickness and contact height are significant, positive physical contact between the electrical conductors or contacts 36 on the printed circuit board 34 and the contacts 26 on the flexible circuitry 22 may be inhibited if the contacts 26 on the flexible circuitry 22 are unable to move relative to one another to compensate for such variations.

In the context of the type of connector element illustrated in FIGS. 1 and 2, it was thought that the adhesive layer 32 which is disposed between the flexible circuitry 22 and the mounting member 14 for purposes of securing the flexible circuitry 22 to the mounting member 14 could also serve the function of allowing the contacts 26 on the flexible circuitry 22 to move relative to one another to compensate for the aforementioned variations in contact height and board thickness. However, it has been found that the adhesive layer 32 is not capable of allowing the individual contacts 26 on the flexible circuitry 22 to move to the extent necessary to compensate for such variations.

One reason for the inability of the adhesive layer 32 to serve the function of a compliant substrate for allowing the individual contacts 26 to move relative to one another is the fact that the adhesive layer is too thin. The adhesive layer 32 applied between the flexible circuitry 22 and the mounting member 14 is on the order of 1–2 mils which has been found to be insufficient to produce the required individualized movement of the contacts 26 relative to one another.

The adhesive layer's inability to serve as a sufficiently compliant substrate also derives from the physical properties of the adhesive layer 32. That is, the adhesive used to secure the flexible circuitry 22 to the mounting member 12 possesses an unacceptably large degree of hardness (i.e., the Shore durometer hardness is relatively high). Thus, the material is not well suited for being readily compressed to allow the individual contacts 26 to move in order to accommodate changes in contact height and wiring board thickness.

To the extent the adhesive material is able to be compressed to a small degree upon the application of a force, it has been found that the adhesive possesses undesirable compression set properties. Generally speaking, compression set refers to a material's inability to be restored to its original form once a compressive force which has been applied to the material is removed. When the daughterboard or plug-in board 34 is inserted into the longitudinal opening 20 in the connector element 12, the wiring board 34 applies a force to the adhesive layer 32. To the extent the adhesive layer 32 is compressed to a relatively small degree upon the application of such a force, the nature of the adhesive is such that the adhesive layer 32 tends to retain its compressed state to a significant extent even when the daughterboard or plug-in board 34 is removed from the connector element 12.

This compression set problem is particularly significant when the daughterboard or plug-in board 34 is retained in the connector element 12 for a long period of time and is then removed and replaced with a different daughterboard or plug-in board. To the extent irregularities in wiring board thickness and/or contact height exist with respect to the first daughterboard or plug-in board 34, the adhesive layer 32 is compressed in a manner corresponding to those irregularities. Then, upon removal of the first daughterboard or plug-in board, it is unlikely that the next wiring board will possess the same irregularities. Consequently, upon insertion of the replacement circuit board, the compression set properties of the adhesive causes the contacts 26 on the flexible circuitry to be incapable of making proper electrical contact with the electrical conductors or contacts on the new wiring board.

In view of the foregoing, it would be desirable to provide a connector assembly for electrically interconnecting two printed circuit board like members which allows individualized compliance of the contacts on the connector assembly to compensate for variations in circuit board thickness and contact height in order to ensure effective electrical contact between the contacts on the connector assembly and the contacts on the printed circuit board like member. It would also be desirable to provide a connector assembly which is not as susceptible to compression set and which can effect the necessary electrical continuity regardless of how long a wiring board is retained within the connector assembly.

SUMMARY OF THE INVENTION

In accordance with one aspect of the present invention, a connector assembly for electrically interconnecting a first printed circuit board like member having electrical contacts thereon with a second printed circuit board having electrical contacts thereon includes an elongated biasing member for being mounted on a first printed circuit board like member and flexible circuitry disposed on the biasing member. The elongated biasing member is generally C-shaped and includes arm portions which each terminate at a respective free end. The arm portions of the biasing member are spaced apart to define therebetween a longitudinal opening that extends between the opposite ends of the biasing member for receiving a second printed circuit board like member. The flexible circuitry includes a plurality of generally parallel-spaced electrical conductors for being electrically connected with the electrical contacts on the first printed circuit board like member when the biasing member is mounted on the first printed circuit board like member. The plurality of generally parallel-spaced electrical conductors on the flexible circuitry each terminate at a contact pad. The flexible circuitry is positioned on the biasing member so that the contact pads are positioned on at least one of the arm portions of the biasing member on at least one side of the longitudinal opening to provide an electrical connection with the electrical contacts on the second printed circuit board like member when the second printed circuit board like member is received within the longitudinal opening. An elastomer sheet is positioned between the at least one arm portion of the biasing member and the contact pads of the flexible circuitry for allowing individual contact pads to move relative to other contact pads. In addition, an adhesive means is provided for adhering the elastomer sheet to at least one of the flexible circuitry and the arm portion of the biasing member. In accordance with a preferred embodiment, the elastomer sheet possesses a thickness of at least 3 mils and is made of a closed cell polyurethane or silicone.

In accordance with another aspect of the present invention, a connector assembly for electrically interconnecting first and second printed circuit board like members which each have electrical contacts thereon includes an elongated biasing member for being mounted on a first printed circuit board like member and flexible circuitry disposed on the biasing member. The biasing member is provided with spaced apart arm portions which define therebetween a longitudinal opening adapted to receive a second printed circuit board like member. The flexible circuitry includes a plurality of generally parallel-spaced electrical conductors positioned on at least one side of the longitudinal opening to provide an electrical connection with the electrical contacts on the second printed circuit board like member when the second printed circuit board like member is received within the longitudinal opening. Compliant means is also positioned between the flexible circuitry and the biassing member on the at least one side of the longitudinal opening for providing compliance of individual electrical conductors of the flexible circuitry relative to other electrical conductors of the flexible circuitry. Also, a securing arrangement is provided to secure the compliant means at a predetermined position between the flexible circuitry and the biasing member.

BRIEF DESCRIPTION OF THE DRAWING FIGURES

DETAILED DESCRIPTION OF THE INVENTION

Figure 1:
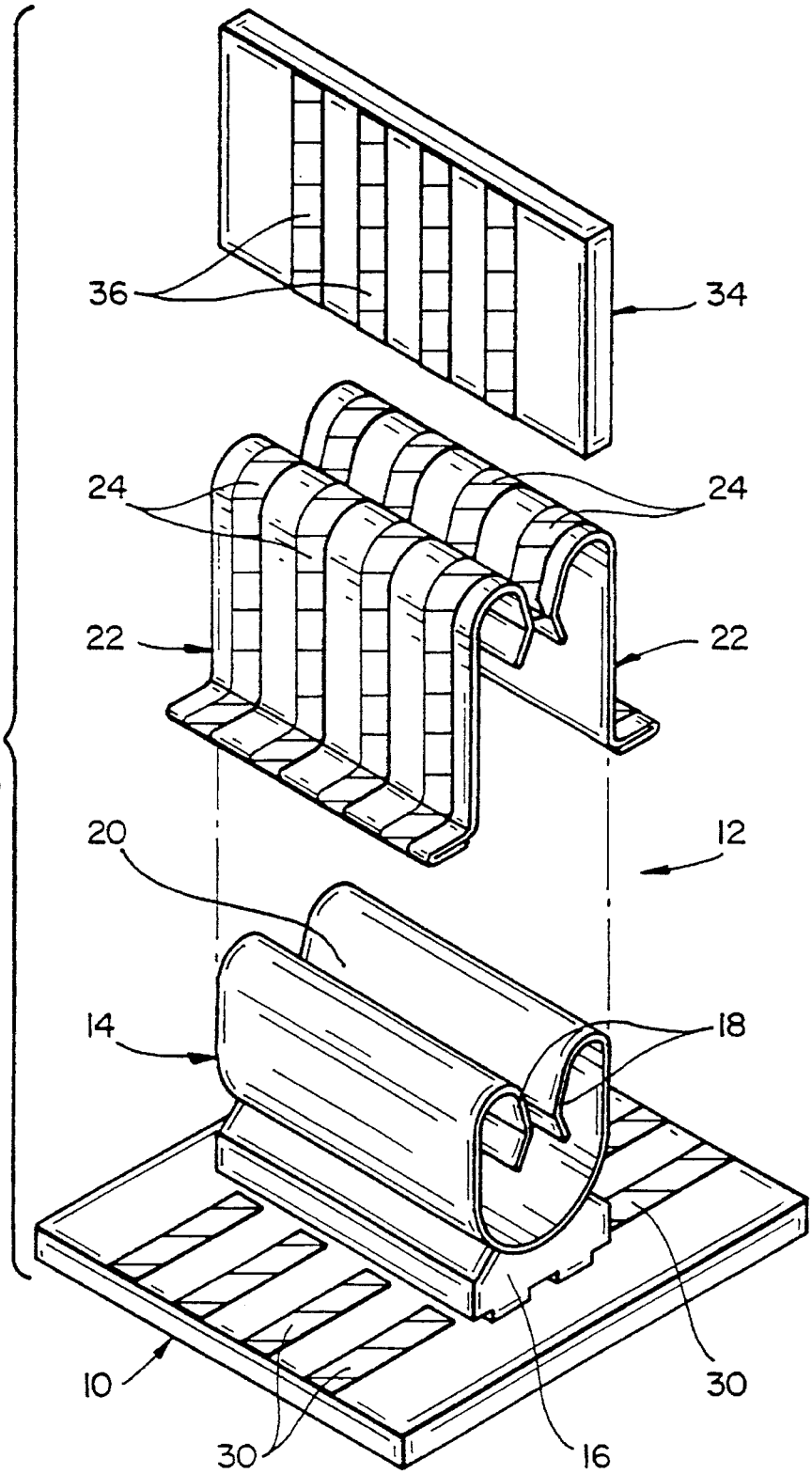
FIG 1 (PRIOR ART)
FIG. 1 is a perspective exploded view illustrating a known connector element for electrically interconnecting two printed circuit boards.
Figure 2:
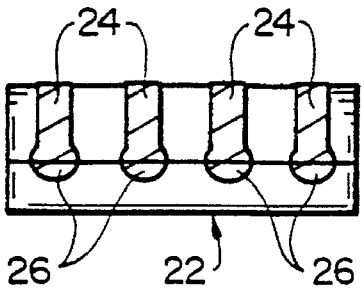
FIG 2 (PRIOR ART)
FIG. 2 is a plan view of a portion of the flexible circuitry used in the connector element illustrated in FIG. 1.
Figure 3:
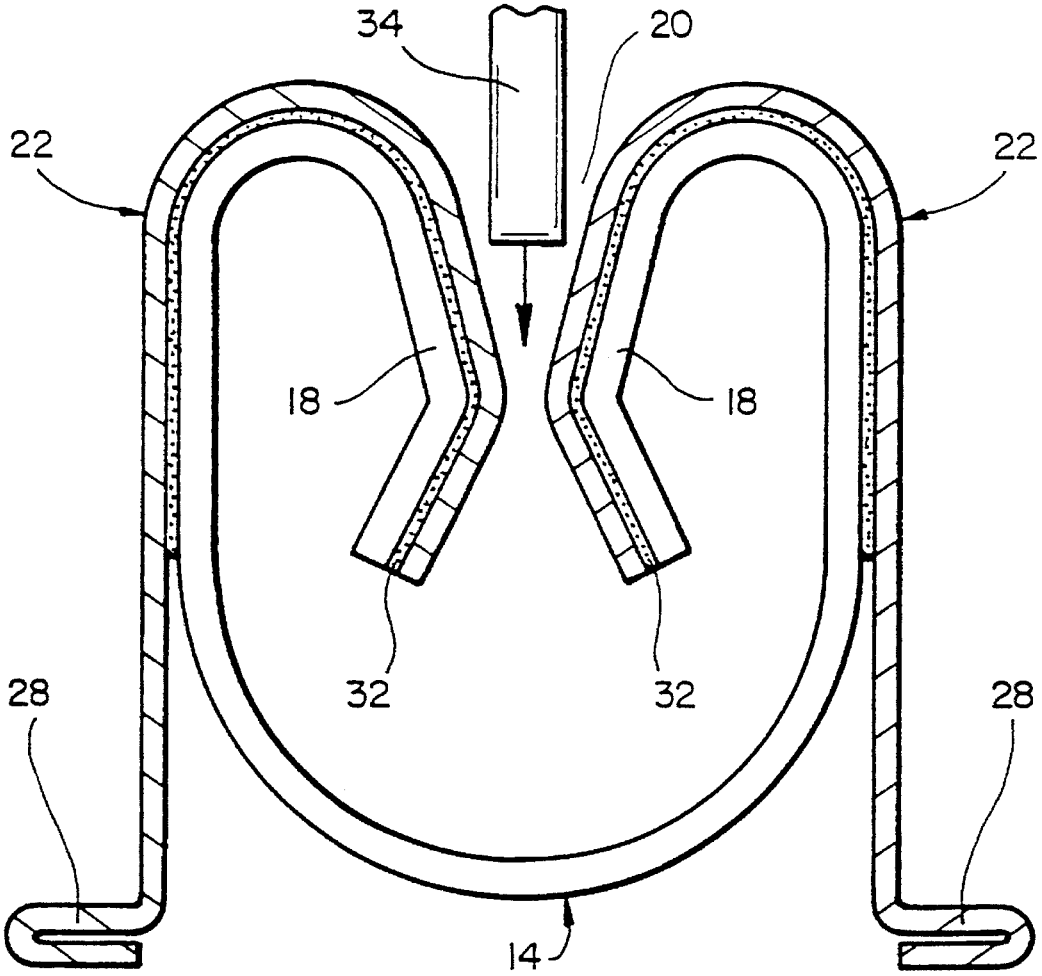
FIG 3 (PRIOR ART)
FIG. 3 is an enlarged end view of the connector element shown in FIG. 1 illustrating the way in which the flexible circuitry is adhesively attached to the mounting member.
Figure 4:
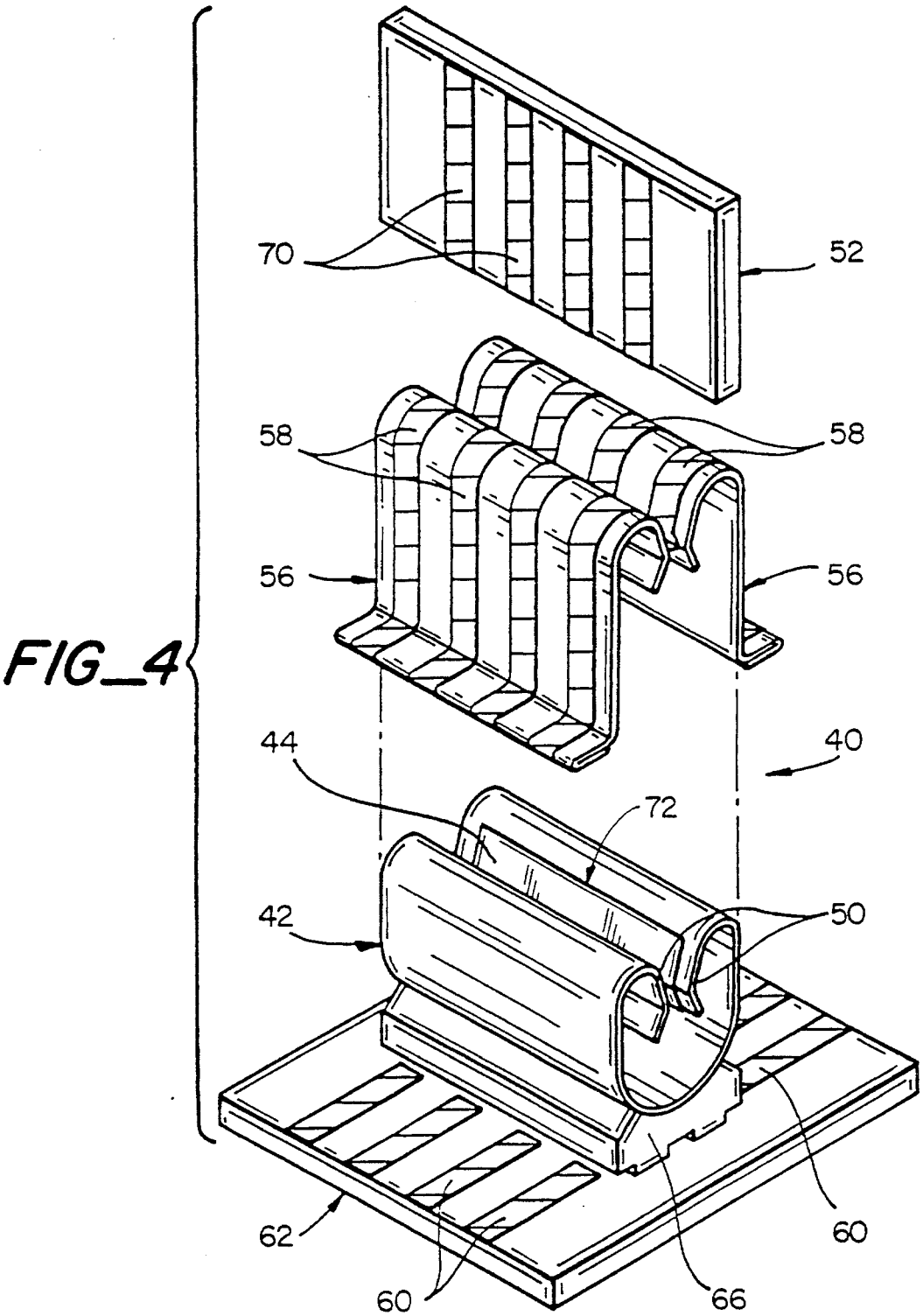
FIG. 4 is a perspective exploded view of a connector assembly according to the present invention.

With reference initially to FIG. 4, the connector assembly 40 according to the present invention includes a biasing member 42 which can be fabricated from any resilient, spring-like material such as beryllium copper. The elongated biasing member 42 is generally C-shaped and is provided with a longitudinal opening 44 which extends between opposite ends of the biasing member 42.

Figure 5:
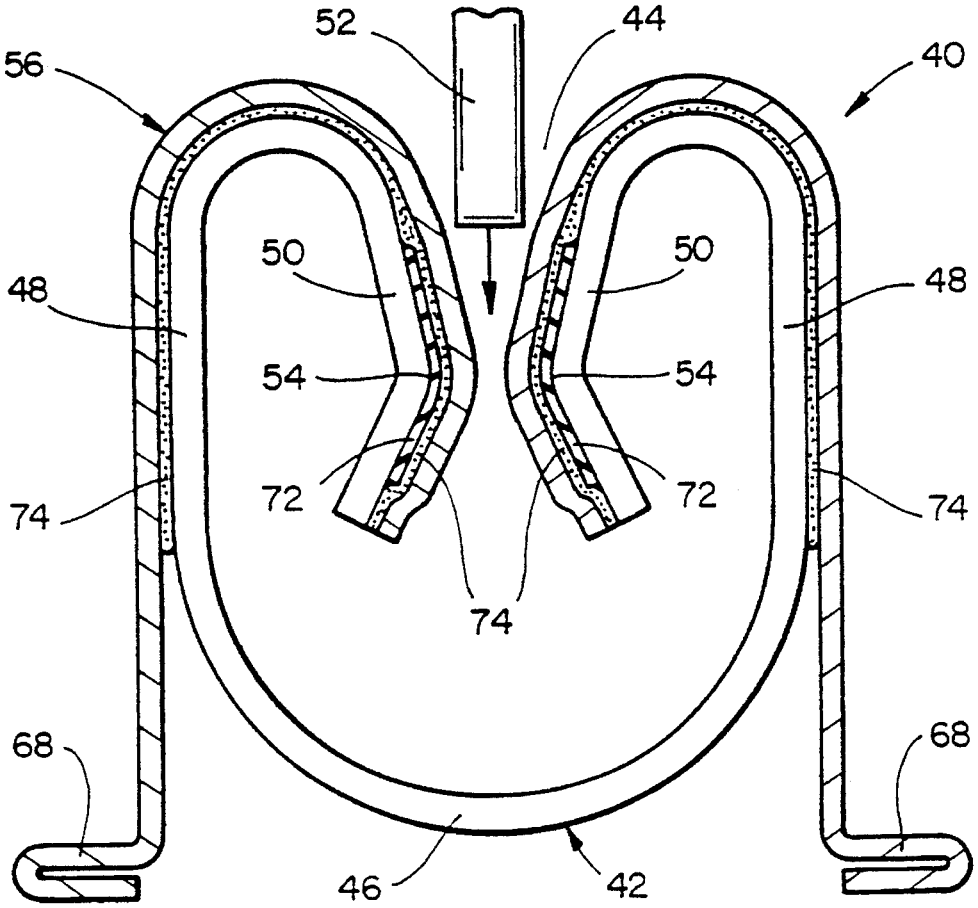
FIG. 5 is an enlarged end view of the connector assembly illustrated in FIG. 4.

As best seen in FIG. 5, the biasing member 42 includes a curved bottom portion 46, two generally upstanding leg portions 48 and two spaced apart arm portions 50 which each terminate at a free end. The free ends of the arm portions 50 are directed inwardly towards the interior of the biasing member 42.

The arm portions 50 define generally cantilevered members which are spaced apart on opposite sides of the longitudinal opening 44. In addition, the arm portions 50 comprise generally flat planar surfaces that face towards one another on opposite sides of the longitudinal opening 44 and that are capable of being urged away from one another upon insertion of a printed circuit board like member 52 such as a daughterboard or plug-in board. Each of the arm portions 50 is preferably shaped to include generally convex or pointed contact areas 54 which constitute the areas of the arm portions 50 that are located closest to one another.

The biasing member 42 is illustrated in FIG. 4 as being mounted on the printed circuit board like member 62 by way of a mounting block 66. If desired, the biasing member could also be mounted directly on the surface of the underlying wiring board 62.

Figure 6:
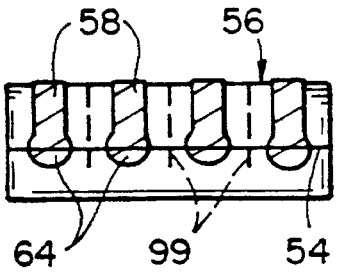
FIG. 6 is a plan view of a portion of the flexible circuitry used in the connector element illustrated in FIGS. 4 and 5.

As illustrated in FIGS. 4 and 5, flexible circuitry 56 is disposed on the outer surface of the biasing member 42. The flexible circuitry 56 includes generally parallel-spaced electrical conductors or etched traces 58 which are adapted to be electrically connected to electrical conductors or contacts 60 on a first printed circuit board like member 62 (e.g., motherboard or back plane board). As seen in FIG. 6, each of the electrical conductors 58 on the flexible circuitry 22 terminates in a contact 64 which is disposed in the region of the contact area 54 of the biasing member 42. The ends or leads 68 of the flexible circuitry 56 are adapted to be connected to the electrical conductors or contacts 60 on the printed circuit board like member 62. Further details concerning the construction of the flexible circuitry 56 are described in U.S. Pat. Nos. 4,881,908 and 4,911,643, the entire disclosures of which are incorporated herein by reference.

When mounted on the biasing member 42, the flexible circuitry 56 is disposed on the arm portions 50 of the biasing member 42 and along a significant part of the upstanding leg portions 48. The flexible circuitry 56 in the area of the arm portions 50 is positioned on opposite sides of the longitudinal opening 44 so as to receive therebetween the printed circuit board like member 52 having electrical conductors or contacts 70 provided thereon. When the printed wiring board 52 is inserted into the longitudinal opening 44 in the connector assembly, the electrical contacts 64 on the flexible circuitry 56 are brought into mating engagement with the electrical contacts or conductors 70 on the printed wiring board 52. As a result, electrical continuity is established between the electrical contacts or conductors 70 on the daughterboard 52 and the electrical contacts or conductors 60 on the motherboard 62.

To provide a compliant support structure for allowing individualized movement of the contacts 64 on the flexible circuitry 22 relative to other contacts 64, an elastomer sheet 72 is interposed between the flexible circuitry 56 and the biasing member 42. As seen in FIGS. 4 and 5, an elastomer sheet 72 is positioned on each of the arm portions 50 of the biasing member and extends over the contact areas 54. Preferably, the elastomer sheets 72 are only provided on the arm portions 50 of the biasing member 42 and do not extend to the upstanding leg portions 48 of the biasing member 42.

As illustrated in FIG. 5, an adhesive layer 74 is provided to adhere the flexible circuitry 56 to the biasing member 42. The adhesive layer 74 is provided on the flexible circuitry 56 so that the flexible circuitry 56 is adhered to the biasing member 42 in the region of the arm portions 50 of the biasing member and along a significant part of the upstanding leg portions 48.

The adhesive layers 74 also secure the elastomer sheets 72 to the flexible circuitry 56. The elastomer sheets 72 can also be adhered to the biasing member 42 if desired. As an alternative to the adhesive layers 74, the elastomer sheets can be secured to the biasing member 42 through use of other appropriate securing means.

The elastomer sheets 72 are fabricated of a material possessing compliant properties which are suitable for effecting movement of each of the individual contacts 64 on the flexible circuitry 22 relative to the other contacts 64. In addition, the elastomer sheets are fabricated of a material that does not pose significant compression set problems. Several materials which have been found to be particularly useful in this regard are closed cell polyurethane and silicone. In addition, the hardness (softness) of the elastomer sheet should be on the order of 30–40 as measured on the Shore Durometer A.

The elastomer sheets should also possess a thickness which allows the individual contacts 64 to deflect by an amount sufficient to compensate for contact height variations and changes in printed wiring board thickness. All other factors being equal, the amount of deflection of the individual contacts 64 of the flexible circuitry 56 is a function of the thickness of the underlying elastomer sheet. That is, if the softness of the elastomer sheet is kept constant, a thicker elastomer sheet will deflect more under a given force than a thinner elastomer sheet under the same force. In the context of the connector assembly of the present invention, it has been found useful to employ elastomer sheets having a thickness of at least 3 mils to provide the necessary individual compliance of the individual contacts 64. Depending upon the softness or hardness of the elastomer material selected, the elastomer sheet can have a thickness between 3 mils and 10 mils. To the extent the elastomer sheets are fabricated of a material having a slightly greater hardness, the elastomer sheets should be made slightly thicker to provide the necessary compliance.

By providing elastomer sheets 72 in accordance with the present invention, the individual contacts 64 on the flexible circuitry 56 can move relative to one another to compensate for differences in height of the contacts or conductors 70 on the printed circuit board like member 52 as well as thickness variations at different regions across the printed circuit board like member 52. Thus, electrical continuity can be assured when the printed circuit board like member 52 is inserted between the contacts 64 disposed on the spaced apart arm portions 50 of the biasing member.

Further, the material utilized for the elastomer sheet 72 is not as susceptible to compression set problems. Consequently, a printed circuit board like member 52 can be inserted into the connector assembly 40 and retained in place for long periods of time without raising significant concerns that the elastomer sheets will be permanently compressed in a manner that conforms to contact height and board thickness variations which are peculiar to a single printed circuit board like member.

FIG. 6 illustrates a slightly modified form of the flexible circuitry 80 that could be placed on the biasing member 42. This flexible circuitry includes generally parallel-spaced electrical conductors or etched traces which terminate in a first row of contacts 84 and a second row of contacts 86. The two rows of contacts are staggered with respect to one another to provide increased contact density and an increased size of the contact area.

Figure 7:
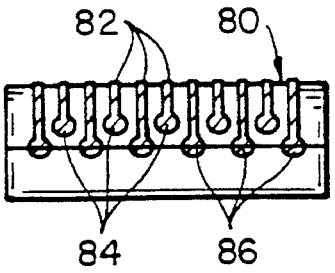
FIG. 7 is a plan view of a portion of an alternative disposition of contacts on the flexible circuitry which can be used in the connector assembly illustrated in FIGS. 4 and 5.
Figure 8:
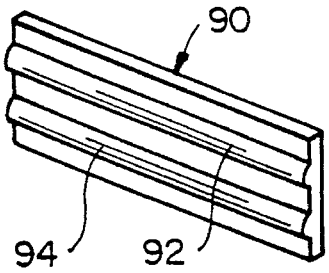
FIG. 8 is an enlarged perspective view of another form of the elastomer strip for use in connection with a connector assembly employing the flexible circuitry illustrated in FIG. 7.

In connection with the flexible circuitry illustrated in FIG. 6, an elastomer sheet such as that illustrated in FIG. 7 can advantageously be employed. The elastomer sheet 90 includes two spaced apart and parallel ribs 92, 94. The ribs 92, 94 are positioned so that when the elastomer strips 90 are positioned between the arm portions 50 of the biasing member 42 and the flexible circuitry, one of the ribs 92 is positioned behind and in alignment with one of the rows of contacts 84 on the flexible circuitry 80 while the other rib 94 of the flexible circuitry 80 is positioned behind and in alignment with the other row of contacts 86. Thus, the elastomer strips 90 provide not only individualized compliance for each of the contacts 84, 86, but also provides a mechanism for effecting compliance between the contacts 84 in one row relative to the contacts 86 in the other row.

It is to be understood that the elastomer sheets utilized in connection with the flexible circuitry having a single row of contacts such as that illustrated in FIG. 6 can also be provided with a single rib similar to the ribs 92, 94 illustrated in FIG. 7. In such a case, the single rib would be aligned with and positioned behind the single row of contacts on the flexible circuitry. Also, although the elastomer sheets have been illustrated as being used in connection with a connector assembly comprising the combination of a biasing member and flexible circuitry having the configuration and features illustrated in FIGS. 4–7, it is to be understood that the elastomer sheets could also be used in connection with other types of connector assemblies for achieving the advantages discussed above. Further, additional compliance can be imparted to the contacts on the flexible circuitry by providing slits (see the dotted outlines 99 of through slits in FIG. 6) extending through the flexible circuitry between the adjacently positioned contacts and etched tracings on the flexible circuitry. In that way, when a force is applied to one of the contacts of the flexible circuitry, the deflection imparted to that contact does not affect adjacent contacts. Consequently, even greater independent movement of the individual contacts of the flexible circuitry is possible.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A connector assembly for electrically interconnecting a first printed circuit board like member having electrical contacts thereon with a second printed circuit board like member having electrical contacts thereon, comprising:

an elongated support member for being mounted on a first printed circuit board like member, said support member having opposite ends and being generally C-shaped as seen from one of the ends of the support member, said support member having arm portions which each terminate at a respective free end, the arm portions of the support member being spaced apart to define therebetween a longitudinal opening extending between the opposite ends of the support member for receiving a second printed circuit board like member;

flexible circuitry mounted on said support member, said flexible circuitry including a plurality of generally parallel-spaced electrical conductors for being electrically connected with the electrical contacts on the first printed circuit board like member when the support member is mounted on the first printed circuit board like member, said plurality of generally parallel-spaced electrical conductors on the flexible circuitry each terminating at a contact pad, the flexible circuitry being positioned on the support member so that contact pads are positioned on at least one of the arm portions of the support member on at least one side of the longitudinal opening to provide an electrical connection with the electrical contacts on the second printed circuit board like member when the second printed circuit board like member is received within the longitudinal opening, at least some of the contact pads being aligned in a row;

an elastomer sheet positioned between the at least one arm portion of the support member and the flexible circuitry, at least one upstanding rib extending from the elastomer sheet and positioned in alignment with the aligned row of contact pads, said elastomer sheet being fabricated of material which possesses compliant properties and which is of a thickness that allows individual contact pads of the flexible circuitry to move relative to other contact pads when the second printed circuit board like member is received within the longitudinal opening; and means for adhering the elastomer sheet to at least one of the flexible circuitry and the arm portion of the support member.

2. The connector assembly according to claim 1, wherein said flexible circuitry includes contact pads positioned in overlying relation on both arm portions of the support member so that contact pads are located on opposite sides of the longitudinal opening, and including an elastomer sheet positioned between each arm portion of the support member and the respective overlying contact pads, each elastomer sheet being provided with at least one upstanding rib.

3. The connector assembly according to claim 1, wherein said contact pads on said flexible circuitry are aligned in two different rows, said elastomer sheet including two upstanding ribs, each of the upstanding ribs being in alignment with one of the rows of aligned contact pads on the flexible circuitry.

4. The connector assembly according to claim 1, wherein said elastomer sheet extends over only a portion of the at least one arm portion of the support member.

5. The connector assembly according to claim 1, wherein the elastomer sheet has a thickness of at least 3 mils.

6. The connector assembly according to claim 1, wherein said elastomer sheet is a sheet of closed cell polyurethane.

7. The connector assembly according to claim 1, wherein said elastomer sheet is a sheet of silicone.

8. A connector assembly for electrically interconnecting first and second printed circuit board like members which each have electrical contacts thereon, comprising an elongated support member for being mounted on a first printed circuit board like member, said support member having spaced apart arm portions which define therebetween a longitudinal opening for receiving a second printed circuit board like member, flexible circuitry mounted on said support member, said flexible circuitry including a plurality of generally parallel-spaced electrical conductors for being electrically connected with the electrical contacts on the first printed circuit board like member when the support member is mounted on the first printed circuit board like member, said plurality of generally parallel-spaced electrical conductors each terminating in a contact pad, the contact pads being positioned on at least one side of the longitudinal opening to provide an electrical connection with the electrical contacts on the second printed circuit board like member when the second printed circuit board like member is received within the longitudinal opening, a plurality of slits extending through the flexible circuitry and positioned between adjacent contact pads to permit adjacent contact pads to move in an individualized manner, an elastomer sheet positioned between the flexible circuitry and the support member on said at least one side of the longitudinal opening, said elastomer sheet being fabricated of a material which possesses compliant properties and which is of a thickness that allows individual contact pads of the flexible circuitry to move relative to other contact pads of the flexible circuitry when the second printed circuit board like member is received within the longitudinal opening, and means for securing the elastomer sheet at a predetermined position between the flexible circuitry and the support member.

9. The connector assembly according to claim 8, wherein the flexible circuitry is mounted on the support member so that the electrical conductors on the flexible circuitry are positioned on both arm portions of the support member and are located on both sides of the longitudinal opening, and including two separate and spaced apart elastomer sheets which are each positioned between the flexible circuitry and one of the arm portions.

10. The connector assembly according to claim 9, wherein the contact pads on the flexible circuitry are aligned in at least two rows, and including an elastomer sheet positioned on each arm portion of the support member between the flexible circuitry and the arm portion, each elastomer sheet including two upstanding ribs, each upstanding rib being positioned in alignment with one of the rows of aligned contact pads.

11. The connector assembly according to claim 10, wherein each elastomer sheet has a thickness of at least 3 mils.

12. The connector assembly according to claim 11, wherein each elastomer sheet is a sheet of closed cell polyurethane.

13. The connector assembly according to claim 11, wherein each elastomer sheet is a sheet of silicone.

14. The connector assembly according to claim 9, wherein said compliant means includes an elastomer sheet having a thickness of at least 3 mils.

15. The connector assembly according to claim 1, wherein said support member is a biasing member made of resilient material.

16. The connector assembly according to claim 8, wherein said support member is a biasing member made of resilient material.

17. The connector assembly according to claim 8, wherein said contact pads on the flexible circuitry are aligned in at least one row, said elastomer sheet including at least one upstanding rib that is positioned in alignment with the row of aligned contact pads.

* * * * *